United States Patent [19]

Simon

[11] Patent Number: 4,901,002

[45] Date of Patent: Feb. 13, 1990

[54] CURRENT SOURCE HAVING A WIDE RANGE OF OUTPUT VOLTAGES

[75] Inventor: Marc Simon, Luc/Mer, France

[73] Assignee: U.S. Philips Corporation, New York, N.Y.

[21] Appl. No.: 315,009

[22] Filed: Feb. 23, 1989

[30] Foreign Application Priority Data

Mar. 4, 1988 [FR] France ..... 88 02772

[51] Int. Cl.[4] ..... G05F 3/26

[52] U.S. Cl. ..... 323/312; 323/315; 330/311

[58] Field of Search ..... 323/311, 312, 315, 316, 323/317; 307/296.6; 330/288, 311; 455/192

[56] References Cited

U.S. PATENT DOCUMENTS 2,888,525 5/1959 Eckess et al. ..... 330/311

3,940,683 2/1976 Blauschild ..... 323/311

4,166,971 9/1979 Schneider ..... 330/288

*Primary Examiner*—William H. Beha, Jr.

*Attorney, Agent, or Firm*—Bernard Franzblau

[57] ABSTRACT

A current source having a wide range of output voltages. The emitter-collector path of a main transistor ($T_{30}$) of the npn type, arranged to define the value of the current, is connected in series with the collector-emitter paths of a plurality of cascaded npn-type output transistors ($T_{31} \ldots T_{35}$). Each output transistor ($T_{31} \ldots T_{35}$) is associated with a respective control transistor ($T'_{31} \ldots T'_{35}$) of the opposite type. At least some of the control transistors have their emitters connected to respective collectors of output transistors of a different rank. This yields an output voltage $V_s$ which can range between small values and a value close to the supply voltage $V_c$.

6 Claims, 2 Drawing Sheets

CURRENT SOURCE HAVING A WIDE RANGE OF OUTPUT VOLTAGES

BACKGROUND OF THE INVENTION

The present invention relates to a current source having a wide range of output voltages, in which source the emitter-collector path of a main transistor, arranged to define the value of the current of the current source, is arranged in series with the emitter-collector path of at least one output transistor.

Such a current source is known from U.S. Pat. No. 3,940,683.

By arranging at least one output transistor in series it is possible to obtain output voltages higher than those normally attainable with the I.C. fabrication process for a transistor, but the maximum output voltage then differs substantially from the available supply voltage, which difference increases as the number of output transistors increases.

SUMMARY OF THE INVENTION

The invention proposes a current source of the type defined in the opening paragraph, whose current is comparatively large and which can operate at output voltages ranging between one collector-emitter voltage of an output transistor in the saturation mode $V_{CEsat}$ and a value as close as possible to the supply voltage.

The principle underlying the invention is to combine each output transistor with an associated control transistor of the opposite type whose emitter potential is fixed by coupling this control transistor to another stage, and to operate the output transistors in the $BV_{CEO}$ mode for low output voltages.

The current source in accordance with the invention is therefore characterized in that it comprises n output transistors, where $n \geqq 2$, the first output transistor having its collector connected to the emitter of the main transistor, the $p^{th}$ transistor, where $1 < p \leqq n$, having its collector connected to the emitter of the $(p-1)^{th}$ transistor, the emitter of the $n^{th}$ transistor constituting the output of the current source, and in that every $q^{th}$ output transistor is associated with a $q^{th}$ control transistor of the opposite type, whose base includes at least one diode poled in the forward direction and referred (i.e. coupled) to a $q^{th}$ reference potential, whose collector is connected to the base of the corresponding $q^{th}$ output transistor, and whose emitter is connected to the collector of the $(q-r)^{th}$ output transistor if $q > r$ and to the collector of the main transistor as well as to a supply voltage source if $q \leqq r$, where $r \geqq 1$.

It is to be noted that U.S. Pat. No. 3,940,683 discloses a circuit of different design, consisting of a current source comprising cascaded transistors in which only the main transistor includes a diode poled in the forward direction in its base.

In a preferred embodiment r is smaller than or equal to the integer contained in b minus one, b being the ratio between the $BV_{CEO}$ values of the npn and pnp transistors, for example, $r=2$ and $p=5$.

In an advantageous embodiment said reference potentials are each fixed at the maximum value corresponding to the minimum possible values for the collector-emitter voltages of the output transistors in the saturation mode $V_{CEsat}$.

BRIEF DESCRIPTION OF THE DRAWINGS

The invention will now be described in more detail, by way of non-limitative example, with reference to the accompanying drawings, in which.

DESCRIPTION OF THE PREFERRED EMBODIMENTS

Figure 1:
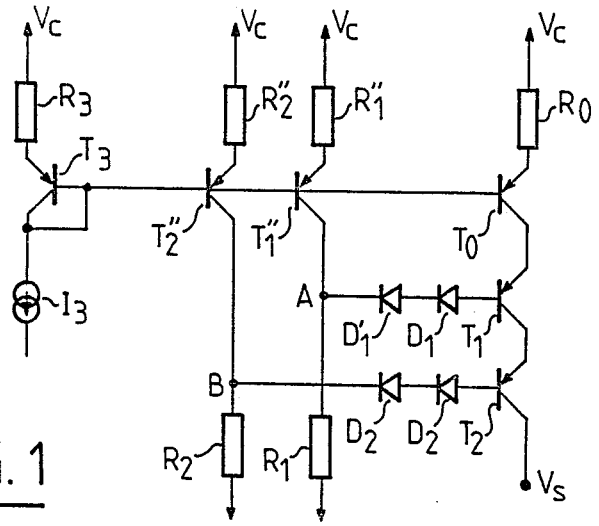
FIGS. 1 to 3 by way of illustration show test circuits not previously published by the Applicant.

In FIG. 1 a pnp-type main transistor $T_0$ has its emitter coupled to a supply voltage source $V_c$ via a resistor $R_0$ and has its collector connected to the emitter of a transistor $T_1$ whose collector is connected to the emitter of a transistor $T_2$. The transistors $T_1$ and $T_2$ have their bases connected to two diodes in series, which diodes ($D_1$, $D'_1$) and ($D_2$, $D'_2$) are poled in the forward direction and serve to ensure that the transistors $T_1$ and $T_2$ are operated in the $BV_{CEO}$ mode for low levels of the output voltage $V_s$. The number of diodes needed is dictated by the values of the voltages to be handled by these diodes. For this purpose the cathodes of the diodes $D'_1$ and $D'_2$ (points A and B respectively) are brought to potentials determined by the current sources ($T''_1$, $R''_1$) and ($T''_2$, $R''_2$) respectively and by the values of the resistors $R_1$ and $R_2$, which are respectively arranged between points A and B and the common mode terminal.

A transistor $T_3$ having its base and collector short-circuited and cooperating with a current source $I_3$ constitutes a conventional current mirror with the transistors $T_0$, $T''_1$ and $T''_2$. The output voltage $V_s$ is available on the collector of the transistor $T_2$. This output voltage varies depending on the load applied to the collector of the transistor $T_2$.

When the output voltage $V_s$ is low (for example of the order of 0.7 V) the transistors $T_1$ and $T_2$ will operate in the $BV_{CEO}$ mode, while the transistor $T_0$ remains in a normal mode of operation. When the output voltage $V_s$ approximates to the value of the supply voltage $V_c$ (for example, 30 V) the transistors $T_1$, $T_2$ and $T_0$ will operate in the saturation mode.

The problem with this circuit arrangement is that it is difficult to realize integrated pnp transistors supplying a collector current which is adequate for specific uses, for example 1 mA for driving a varicap diode of a tuner in a radio or TV receiver.

Figure 2:
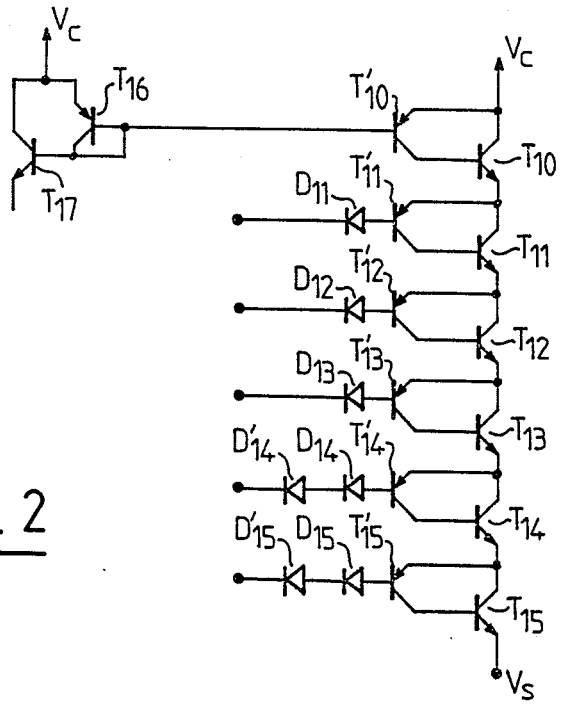

In FIG. 2 this current problem is solved by employing cells comprising a pnp transistor and an npn transistor. The collector current of the pnp transistor is divided by the current gain $\beta$ of the associated npn transistor, which itself can supply an adequate current.

In FIG. 2 each cell comprises an npn transistor ($T_{10}$ . . . $T_{15}$) and a pnp transistor ($T'_{10}$ . . . $T'_{15}$), the collector of the pnp transistor being connected to the base of the associated npn transistor and the emitter of the pnp transistor being connected to the collector of the npn transistor. This type of cell, for use in current sources, is known per se, from GB 1,285,621 (FIG. 9) or German patent application DE-OS 2,157,626 or DE-OS 2,738,205. The transistors $T'_{11}$ to $T'_{15}$ have diodes $D_{11}$, $D_{12}$, $D_{13}$, $D_{14}$ and $D'_{14}$, $D_{15}$ and $D'_{15}$ respectively, poled in the forward direction, connected to their bases and each referred to a given fixed potential. The transistors $T_{16}$ and $T_{17}$ are arranged to form a current mirror with the transistor $T_{10}$.

Thus, three pnp transistors have been replaced by six cells because the $BV_{CEO}$ of an npn transistor is smaller than that of a pnp transistor, in the present example by a factor of approximately 3.

The problem of this arrangement is that as $V_s$, i.e. the output voltage available on the emitter of $T_{15}$, increases its maximum value $V_{smax}$ is limited to $$V_c - 6V_{BE\ npn} - 6V_{CEsat\ pnp}$$

where $V_{BE\ npn}$=base-emitter voltage of an npn transistor ≃0.8 V, $V_p = V_{CEsat}$ pnp=the emitter-collector voltage of a saturated pnp transistor ≃0.1 V, which means that $$V_{smax} = V_c - 5.4V.$$

Figure 3:
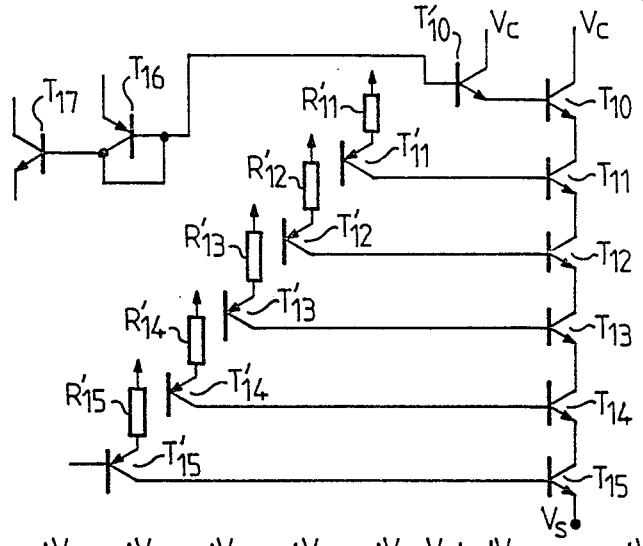

FIG. 3 relates to a circuit arrangement which enables this difference to be reduced and to be brought to approximately 6 $V_{CEsat\ npn}$. In order to achieve this the emitter of the transistors $T'_{11}$ to $T'_{15}$ are no longer connected to the collectors of the transistors $T_{11}$ to $T_{15}$, but are coupled to fixed reference potentials via resistors $R'_{11}$ to $R'_{15}$.

For low output levels the transistor $T'_{15}$ should be operated fully in the $BV_{CEO}$ mode and the emitter voltage of the transistor $T'_{15}$ should be fixed at approximately $V_{s(min)} + V_{BEnpn} + BV_{CEO}$, $V_{s(min)}$ being the minimum value of the voltage $V_s$.

Conversely, for high output levels the collector voltage of the transistor $T'_{15}$ should be very close to $V_C$. This implies inverse operation of this transistor and hence a limited use of this arrangement as regards the output levels.

Figure 4:
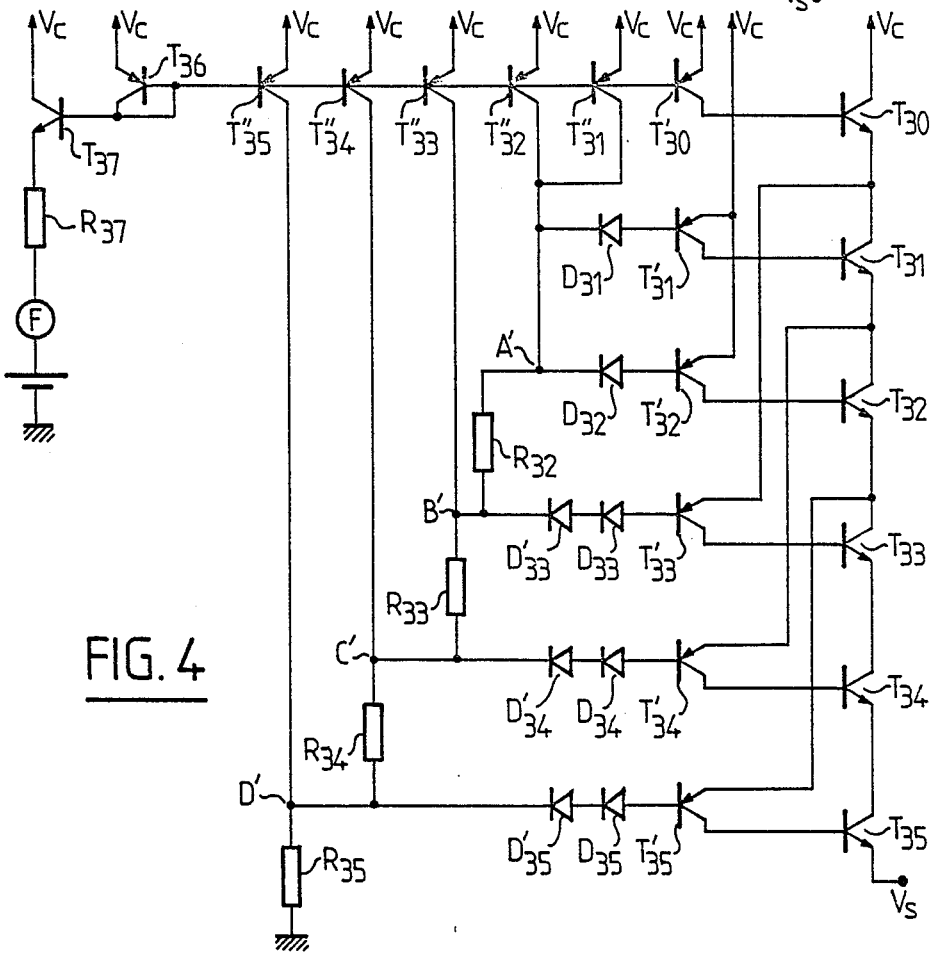
FIG. 4 shows an embodiment of the invention.

The circuit arrangement in accordance with the invention shown in FIG. 4 comprises npn type transistors $T_{30}$ to $T_{35}$ whose collector-emitter paths are arranged in series in the same way as those of the transistors $T_{10}$ to $T_{15}$.

A transistor $T'_{30}$ having its collector connected to the base of the transistor $T_{30}$ and having its emitter connected to the supply voltage source $V_c$ is arranged as a conventional current mirror with the transistors $T_{36}$ and $T_{37}$. The transistors $T'_{31}$ to $T'_{35}$ constituting the control transistors associated with the output transistors $T_{31}$ to $T_{35}$ have their collectors connected to the bases of the transistors $T_{31}$ to $T_{35}$ respectively. The emitters of the transistors $T'_{31}$ and $T'_{32}$ are connected to the supply voltage source $V_C$, and the emitters of the transistors $T'_{33}$ to $T'_{35}$ are connected to the collectors of the transistors $T_{31}$ to $T_{33}$ respectively. The bases of the transistors $T'_{31}$ to $T'_{35}$ are connected to diodes $D_{31}$, $D_{32}$, $D_{33}$ and $D'_{33}$, $D_{34}$ and $D'_{34}$, $D_{35}$ and $D'_{35}$ respectively, which diodes are poled in the forward direction and serve to enable operation in the $BV_{CEO}$ mode in the case of low output voltages $V_s$ on the emitter of the transistor $T_{35}$. The base reference potential of the transistors $T'_{31}$ to $T'_{35}$ is determined by current sources formed by the transistors $T''_{31}$ to $T''_{35}$ arranged as a current mirror with the transistors $T_{36}$ and $T_{37}$, and by four resistors $R_{32}$ to $R_{35}$ arranged in series. The resistors $R_{32}$ to $R_{34}$ are arranged in parallel between the cathodes of the diodes $D_{32}$ and $D'_{33}$ (points A' and B'), $D'_{33}$ and $D'_{34}$ (points B' and C'), $D'_{34}$ and $D'_{35}$ (points C' and D') respectively. The resistor $R_{35}$ is arranged between the cathode of the diode $D'_{35}$ and the common-mode terminal.

This arrangement corresponds to a situation in which $V_c \leqq 6\ BV_{CEO}$(npn) in order to ensure a stable voltage and for which:

$$3BV_{CEO}(npn) = BV_{CEO}(pnp).$$

For a low output voltage $V_s$, the ratio b between the $BV_{CEO}$ of the npn and pnp transistors enables the collector of a control transistor to be connected to that of an output transistor which differs by b−1=2 places in rank. In general it is possible to realize a shift by a number of ranking places equal to the maximum of (aliquot part of b)−1, i.e E(b)−1. The integer part E(b) of a number "b" is the portion of the number to the left of the decimal point.

For high output voltages the emitter potential of, for example, the transistor $T'_{35}$ is equal to the collector potential of the transistor $T_{33}$, so that the drawback of the experimental circuit shown in FIG. 3 is avoided, because the emitter voltage of the transistors $T'_{33}$, $T'_{34}$ and $T'_{35}$ varies as a functiion of the output voltage $V_s$.

Moreover, as will now be shown, the maximum voltage available on the output is closer to $V_c$ than in the experimental circuit of FIG. 2.

Let $V_{BE}$ be the base-emitter voltage of a transistor (approximately 0.7 V).

Let $V_n$ be the emitter-collector voltage of a saturated npn transistor.

Let $V_p$ be the emitter-collector voltage of a saturated pnp transistor.

For high output voltages $V_s$ the transistors $T_{30}$ to $T_{35}$ and $T'_{30}$ to $T'_{35}$ are saturated.

The emitter voltage of $T_{30}$ can reach the value $$V_c - V_p - V_{BE}$$

The emitter voltage of $T_{31}$ can reach the value $$V_c - V_p - V_n - V_{BE}$$

The emitter voltage of $T_{32}$ can reach the value $$V_c - V_p - 2V_n - V_{BE}$$

The emitter voltage of $T_{33}$ can reach the value $$V_c - 2V_p - 2V_{BE}$$

The emitter voltage of $T_{34}$ can reach the value $$V_c - 2V_p - V_n - 2V_{BE}.$$

The maximum output voltage $V_s$ available on the emitter of the transistor $T_{35}$ can reach the value $$V_c - 2V_p - 2V_n - 2V_{BE}.$$

By way of example a method of fabricating bipolar integrated circuits, enabling analog and digital circuits to be integrated simultaneously, has the following characteristic values:

$$V_n = 0.1\ V,\ V_p = 0.1\ V,\ V_{BE} \simeq 0.8\ V$$

$$BV_{CEO}npn = 5\ V$$

$$BV_{CEO}pnp = 15\ V$$

The maximum permissible voltage is then:

$V_s = V_c - 1.8$ V.

For the number of cascaded transistors in FIG. 4 the circuit can be powered with 30 V, which for example enables a varicap diode to be operated between approximately 0.7 V and 28 V. Since the diodes are formed by means of npn transistors, which can handle a maximum voltage of 20 V (operation in the $BV_{CEO}$ mode), the voltages to be handled being higher than said value for the bases of the transistors $T'_{33}$ to $T'_{35}$, two diodes are required for these transistors.

A requirement to be met is that the transistors $T_{30}$ and $T'_{30}$ should not come into the avalanche region because these are the two transistors which limit the current.

It is advantageous to provide the resistor bridge $R_{32}$ to $R_{35}$ in order to ensure that the base potential of the transistors $T'_{33}$ to $T'_{35}$ has the maximum value corresponding to the minimum possible value for the collector-emitter voltages of the transistors $T_{30}$ to $T_{32}$. The collector voltage of the transistor $T_{31}$ is, for example, $V_{B'} + 3V_{BE}$, $V_{B'}$ being the voltage on point B'. The potentials on points A', C' and D' are referred to as $V_{A'}$, $V_{C'}$ and $V_{D'}$.

For example, the following relationship may be used:

$$V_C - V_{A'} = V_{D31} + V_{BE}(T'_{31})$$

where $V_{D31}$ is the voltage across the diode $D_{31}$ $V_{BE}(T'_{31})$ = the base-emitter voltage of the transistor $T'_{31}$ in the $BV_{CEO}$ region.

The voltages on points B', C' and D' are then dictated by the requirement imposed by the above relationship.

Thus, the circuit shown in FIG. 4 enables the advantages of the circuits shown in FIGS. 2 and 3 to be obtained without their drawbacks. The circuits shown in FIG. 4 has the additional advantage that the difference between the collector currents of the transistors $T_{30}$ and $T_{35}$ is small in comparison with the situation in FIG. 3, because the currents drawn by the pnp transistors are re-injected into the npn transistors.

Another advantage of this circuit arrangement is that it can operate even in the case where the transistors $T'_{33}$ to $T'_{35}$ are in the $BV_{CEO}$ mode, the main current being limited by the transistor $T_{30}$.

I claim:

1. A current source having a wide range of output voltages, said source comprising: an emitter-collector path of a main transistor of the npn type, arranged to define the value of the current of the current source, connected in series with the emitter-collector paths of n output transistors of the npn type, where $n \geqq 2$, each of said ouput transistors having an emitter, a base and a collector, a first output transistor having its collector connected to the emitter of the main transistor, a $p^{th}$ output transistor, where $1 < p \leqq n$, having its collector connected to the emitter of the $(p-1)^{th}$ output transistor, the emitter of the $n^{th}$ output transistor constituting an output of the current sourse, wherein every $q^{th}$ output transistor is associated with a $q^{th}$ control transistor of the opposite type, whose base includes at least one diode poled in the forward direction and referred to a $q^{th}$ reference potential, whose collector is connected to the base of the $q^{th}$ output transistor, and whose emitter is connected to the collector of the $(q-r)^{th}$ output transistor if $q > r$ and to the collector of the main transistor and to a supply voltage source if $q \leqq r$, where $r \geqq 1$.

2. A current source as claimed in claim 1, wherein $r \leqq E(b) - 1$, where b is the ratio between the $BV_{CEO}$ values of the npn and pnp transistors and E(b) is the integer part of b.

3. A current source as claimed in claim 2, wherein $r = 2$ and $p = 5$.

4. A current source as claimed in claim 3, wherein said reference potential is fixed at a maximum value corresponding to the minimum possible values for the collector-emitter voltages of the output transistors in a saturation mode.

5. A current source as claimed in claim 1, wherein said reference potential is fixed at a maximum value corresponding to the minimum possible values for the collector-emitter voltages of the output transistors in a saturation mode.

6. A current source as claimed in claim 2, wherein said reference potential is fixed at a maximum value corresponding to the minimum possible values for the collector-emitter voltages of the output transistors in a saturation mode.

* * * * *